United States Patent [19]

Yurkov et al.

[11] Patent Number: 4,589,969

[45] Date of Patent: May 20, 1986

[54] ELECTRODE FOR ELECTROLYSIS OF SOLUTIONS OF ELECTROLYTES AND PROCESS FOR PRODUCING SAME

[76] Inventors: Leonid I. Yurkov, Tashkentskaya ulitsa, 22, korpus 1, kv. 1; Vladimir B. Busse-Machukas, Izmailovsky bulvar, 37, kv. 27; Florenty I. Lvovich, I Nizhnemikhailovsky proezd, 16, kv. 55; Vladimir L. Kubasov, Kirovogradskava ulitsa, 4, korpus, 2, kv. 135, all of Moscow; Alexandr A. Uzbekov, Naberezhno-Kreschatitskaya ulitsa, 11, kv. 49, Kiev; Anatoly F. Mazanko, Stavropolskava ulitsa, 56, korpus 1, kv. 73; Natalya S. Fedotova, ulitsa Sayanskaya, 6, kv. 143, both of Moscow, all of U.S.S.R.

[21] Appl. No.: 660,513

[22] Filed: Oct. 12, 1984

[51] Int. Cl.[4] ..... B05D 5/12; C25C 7/02

[52] U.S. Cl. ..... 204/290 F; 427/126.5; 427/126.6; 502/101

[58] Field of Search ..... 204/290 F; 427/126.5, 427/126.6; 502/101

[56] References Cited

U.S. PATENT DOCUMENTS

| | | | |
|---|---|---|---|
| 3,855,092 | 12/1974 | O'Leary | 204/128 |
| 3,948,751 | 4/1976 | Bianchi | 204/98 |
| 4,223,049 | 9/1980 | Murray | 204/290 F |

*Primary Examiner*—John F. Niebling

*Attorney, Agent, or Firm*—Burgess, Ryan and Wayne

[57] ABSTRACT

The present invention relates to electrochemistry.

An electrode for electrolysis of solutions of electrolytes comprises a substrate of a passivated metal and a coating applied onto this substrate and consisting of a mixture of oxides of ruthenium, titanium and tin at the following proportions thereof, molar percent:

| | |
|---|---|
| ruthenium oxide | 15–30 |
| titanium oxide | 25–55 |
| tin oxide | 30–60. |

3 Claims, No Drawings

ELECTRODE FOR ELECTROLYSIS OF SOLUTIONS OF ELECTROLYTES AND PROCESS FOR PRODUCING SAME

The present invention relates to electrochemistry and, more particularly, to electrolysis of solutions of electrolytes, more specifically to an electrode for electrolysis of solutions of electrolytes and to a process of producing such an electrode.

FIELD OF THE INVENTION

The present invention is useful, as an anode, in electrolysis of solutions of electrolytes to produce chlorine and an alkali in electrolyzers with a filtering membrane, or with an ion-exchange membrane and in mercury-cathode electrolyzers, as well as in electrolytical processes for the production of chlorates, hypochlorites, in processes of an electrochemical treatment of waste waters, in electroplating processes.

Prior to the beginning of the 1970's mainly graphite electrodes were used as anodes in the electrochemical industry. Graphite electrodes have a number of advantages, namely: a readily-available electrode material is used, anodes are not sensitive towards short-circuits. At the same time, graphite anodes are less effective catalytically which necessitates the use of high voltages on an electrolyzer, they have an increased wear, so that electrolyzers should be frequently disassembled to replace the anode sets. Furthermore, graphite anodes are of large overall dimensions and weight, thus causing undesirable extension of the working size of electrolytical apparatus and necessitating great floor area for electrolysis shops.

BACKGROUND OF THE INVENTION

Most extensively used in the art are metal - oxide anodes with an active coating containing 30 mol. % of ruthenium dioxide and 70 mol. % of titanium dioxide known as DSA (dimensionally stable anodes), in the USSR they are referred to as ORTA (a trademark registered in the Soviet Union). In the USSR ORTA electrodes are protected by USSR Inventor's Certificate No. 369923.

The consumption of the active mass of this electrode under stationary conditions of chlorine electrolysis at a current density of 0.2–0.4 A/cm$^2$, as determined by the radiochemical method, is equal to $2.6\times10^{-8}$ g/cm$^2$.h.

The resistance of the active coating of such an electrode can be determined by the method of variable polarity and amalgamation which is widely employed as a fast method for evaluation of quality of an active coating: resistance to amalgamation, adhesion to the current-conducting substrate, resistance to cathodic polarization and short-circuit resistance.

The results of measurements of the mass consumption of an active coating of an ORTA electrode obtained by the method of variable polarity and amalgamation are shown in the Table hereinbelow.

An ORTA electrode, as compared to a graphite electrode, under the conditions of electrolysis of alkali metal chlorides makes it possible to lower an overvoltage across an electrolyzer and save about 200 kW.h per ton of caustic soda (as calculated for a 100% product), to improve the purity of the electrolysis products, to extend the service life of an anode from 7–8 months to 5–7 years, well as to reduce the expenses for disassembling and reassembling of an electrolyzer for replacement of the electrodes.

TABLE

| Number of test cycles | 1–3 | 4–6 | 7–9 | 10–12 | 13–15 | 16–18 |
|---|---|---|---|---|---|---|
| Consumption of the active mass for every 3 successive cycles of tests, mg/cm$^2$ | 0.595 | 0.610 | 0.140 | 0.180 | 0.190 | 0.170 |

However, ORTA electrodes have the following disadvantages: a relatively high consumption of noble metals especially noticeable in a mass operation of these electrodes; an insufficient resistance of the coating under the conditions of combined evolution of oxygen and chlorine; at an elevated content of oxygen in the anode gas "closing" of an electrode occurs at still relatively high residual content of ruthenium in the active coating of the electrode. These factors lower the electrode operation reliability, especially under the conditions of electrolysis with an ion-exchange membrane.

Known in the art is an electrode for electrochemical processes comprising an electrically conducting substrate of titanium or tantalum, onto which an active coating is deposited consisting of a platinum group metal oxide and a mixture of oxides of metals containing an oxide of titanium or tantalum and at least one more oxide of an alloying metal selected from the group consisting of: tin, silver, chromium, lanthanum, aluminium, cobalt, antimony, molybdenum, nickel, iron, tungsten, vanadium, phosphorus, boron, beryllium, sodium, calcium, strontium, lead, copper, and bismuth. The alloying metal oxide is used in an amount of 0.1 to 50% by weight of titanium dioxide or tantalum pentoxide. The ratio of the content of a platinum group metal to all other metals of the oxide coating is equal to 20:100–85:100. In the case where the active mass of the a prior art electrode contains $TiO_2$, $RuO_2$ and $SnO_2$ the proportions of these components in molar per cent will be as follows: 40–90% of $TiO_2$, 0.25–25% of $SnO_2$ and 9.75–35% of $RuO_2$. A known electrode of the following composition, molar per cent: 21.8% of $RuO_2$, 72.7% of $TiO_2$ and 5.5% of $SnO_2$ after 1,500 hours of tests in a concentrated solution of NaCl at 2 A/cm$^2$ and temperature of 60° C. has an anode potential of 1.42 V. Under test conditions of the variable polarity method (5 anodic and 5 cathodic polarizations at 1 A/cm$^2$, 2 minutes for each polarization) this electrode has a weight loss of 0.09 mg/cm$^2$ after two test cycles and weight loss of 0.01 mg/cm$^2$ after one immersion into amalgam (cf. U.S. Pat. No. 3,948,751 Cl.C 25 B 11/10, 1976).

This electrode has a disadvantage residing in its low resistance.

Also known in the art is an electrode for the electrochemical production of chlorine and an alkali comprising a substrate of a rectifying metal with an active coating deposited thereon and consisting of a mixture of oxides of tin, ruthenium and titanium, the molar ratio of $TiO_2$: :($RuO_2+SnO_2$) being within the range of 1.5–2.5:1 and the content of $SnO_2$ being equal to 35–50 mol. % in a mixture of $SnO_2+RuO_2$ (cf. U.S. Pat. No. 3,855,092 Cl.204–128, 1975).

This electrode has the following composition of the active coating, molar per cent: $TiO_2$—60–75%, $SnO_2$—10–20%, $RuO_2$—15–30%.

A known electrode with the active coating of the following composition: $TiO_2$: $(RuO_2+SnO_2)=2.2:1$ (in molar parts) and at the content of $SnO_2$ of 40 mol. % in a mixture of $RuO_2+SnO_2$, i.e. the active mass having the composition: $TiO_2$ 67%, (molar per cent), $SnO_2$ —13.2%, $RuO_2$ —19.8%, has under the conditions of chlorine electrolysis the loss of ruthenium from the active mass equal to 0.01 g per ton of chlorine. Overtension of chlorine evolution on this prior art electrode is lowered by 40 mV relative to the electrode containing no $SnO_2$ in the active coating.

This prior art electrode also has a disadvantage residing in its insufficient resistance.

OBJECT OF THE INVENTION

It is an object of the present invention to provide such an electrode for electrolysis of solutions of electrolytes which would have an increased resistance during its operation.

It is another object of the present invention to provide such an electrode for electrolysis of solutions of electrolytes which would contain a smaller amount of a noble metal—ruthenium.

It is a further object of the present invention to provide such process which would make it possible to produce an electrode for electrolysis of solutions of electrolytes possessing an increased resistance during its operation and containing a smaller amount of a noble metal—ruthenium.

The present invention is directed to the provision of such an electrode for electrolysis of solutions of electrolytes produced by such a process which would make it possible to improve resistance of the produced electrode during its operation and also to lower the content of a noble metal—ruthenium in the electrode.

SUMMARY OF THE INVENTION

These objects are accomplished by an electrode for electrolysis of solutions of alkali metal chlorides comprising a substrate of a passivating metal having a coating of a mixture of oxides of ruthenium, titanium and tin, wherein according to the present invention this coating contains the above-mentioned ingredients in the following proportions, molar per cent:

| | |
|---|---|
| ruthenium oxide | 15–30 |
| titanium oxide | 25–55 |
| tin oxide | 30–60. |

The present invention makes it possible to improve resistance relative to the known electrode (U.S. Pat. No. 3,855,092) by 1.1–1.2 times.

According to the present invention it is advisable that the electrode coating contain the following proportions of the ingredients, molar per cent:

| | |
|---|---|
| ruthenium oxide | 25–30 |
| titanium oxide | 30–45 |
| tin oxide | 30–40. |

The present invention makes it possible to reduce the consumption of a noble metal—ruthenium by 15–20%, especially during the initial period of operation.

An embodiment of the present invention consists in that for the production of an electrode for electrolysis of solutions of electrolytes a process is used, wherein at least once the following steps are carried out:

(1) application of a coating solution containing chlorides of titanium, ruthenium, tin onto a substrate of a passivating metal;

(2) drying the substrate with the coating applied thereonto at a temperature within the range of from 30° to 150° C.;

(3) calcination of the substrate with the coating applied thereonto;

according to the present invention a coating solution is used which contains as tin chloride tin dichloride, the content of ruthenium, titanium and tin in the coating solution is respectively in the ratio of (0.3–0.7):(0.3–0.6):(0.7–1.5) and calcination is carried out at a temperature within the range of from 350° to 530° C.

Further objects and advantages of the present invention will now become more fully apparent from the following detailed description of an electrode for electrolysis of solutions of electrolytes, a process for producing this electrode and examples illustrating embodiments of this electrode and the process.

DETAILED DESCRIPTION OF THE INVENTION

An electrode for electrolysis of solutions of electrolytes is made of a metal passivated upon an anodic polarization such as titanium, tantalum, zirconium, niobium or an alloy thereof serving as the electrode substrate. The electrode substrate or base can be of any form, e.g. it can be made as a flat plate with or without perforation, a rod, a screen, a grid, a metallic body.

The electrode substrate has a coating of a mixture of oxides or ruthenium, titanium and tin, predominantly dioxides thereof.

According to the present invention these oxides should be contained in the coating in the following proportions, molar percent: ruthenium oxides—15–30, titanium oxides—25–55; tin oxides—30–60. Observance of this conditions makes it possible to improve resistance of the electrode with such a coating and considerably reduce its production costs due to a considerable reduction of the content of ruthenium oxide in the coating, i.e. a noble metal. The latter has become possible owing to the presence, in the coating, of tin oxide in an amount of from 30 to 60 mol. %. As a result of studies it has been found that incorporation of tin dioxide into the coating composition in the amount according to the present invention does not result in restriction of the range of the formation of solid substitution solutions, since tin dioxide has a cystalline structure similar to that of ruthenium dioxide and titanium dioxide contained in the coating. A considerable amount of tin dioxide (30 to 60 mol. %) does not result in a damage of the coating structure. This probably explains the fact that the incorporation of tin dioxide instead of a certain amount of ruthenium dioxide (as in the case of known coatings of a similar application) not only causes no lowering of the corrosion resistance of the coating, but, on the contrary, lowers losses of ruthenium in electrolysis.

Tin, when present in the coating composition in addition to ruthenium, performs the functions of active centers, wherefore at a considerable proportion of tin dioxide and a respective reduction of the proportion of ruthenium dioxide the catalytical properties of the active coating are not impaired, but even increased to a certain extent.

The introduction of tin in an amount of less than 30 mol. % is inexpedient, since it provides no substantial savings on consumption of a noble metal and does not result in any noticeable increase of the corrosion-resistance of the coating. Increasing content of tin dioxide in the active coating above 60 mol. % results in an impaired corrosion-resistance of the electrode which is apparently associated with decomposition of solid solutions into separate phases of individual components.

The introduction of ruthenium dioxide in an amount of less than 15 mol. % does not ensure retaining of metal conductivity of the coating, thus resulting in impaired catalytical properties of the active mass. Increasing content of ruthenium dioxide above 30 mol. % is inexpedient, since at an increased content of ruthenium dioxide no additional effect of reduction of overtension of chlorine evolution is attained, but the corrosion-resistance is lowered due to losses of ruthenium in electrolysis.

The presence of titanium dioxide ensures a high corrosion-resistance of the coating under the conditions of electrolysis within a wide range of pH variations of the anolyte, but a content of titanium dioxide above 55 mol. % results in a decrease of the catalytical activity of the coating and acquisition, by the coating, of semi-conducting properties and in an impaired electrical conductivity of the active mass. It is neither expedient to lower the content of titanium dioxide below 25 mol. %, since in this case the corrosion-resistance of the coating in electrolysis is substantially decreased.

The electrode according to the present invention is produced by application of a coating solution containing chlorides of ruthenium, titanium and tin onto a previously prepared substrate made of a metal passivating upon an anodic polarization.

As ruthenium chloride according to the present invention ruthenium hydroxychloride or ruthenium trichloride are used, as titanium chloride—titanium tetrachloride or titanium trichloride, as tin chloride—tin dichloride.

The coating solution is prepared by mixing aqueous solutions of the above-mentioned compounds so as to ensure the proportions of ruthenum, titanium and tin in the coating solution equal to (0.3–0.7):(0.3–0.6):(0.7–1.5) respectively.

The substrate made, for example, of titanium is degreased in a solution containing 5 g/l of NaOH, 30 g/l of $Na_3PO_4$, 40 g/l of $Na_2CO_3$ for 10 minutes at the temperature of 80° C. Then the substrate is washed and etched in a solution of HCl for 15 minutes at 100° C., followed by washing with demineralized water and drying at the temperature of 40° C.

Afterwards, onto the prepared substrate a coating solution is applied which contains chlorides of ruthenium, titanium and tin at the rate of application, per run, of 1.35 g/m$^2$ of the working surface using 30 ml of the coating solution in one operation. After application of the coating solution the electrode is dried at a temperature of from 30° to 150° C., then calcined at a temperature of 370° to 530° C. for 20 minutes.

The electrode is made multi-layered, each successive layer being deposited following the above-specified order of operations.

According to the present invention, the calcination of the substrate with the coating applied thereto should be carried out at a temperature within the range of from 370° to 530° C., since only at this temperature a complete transition of tin chloride into tin oxide is reached.

As it follows from the foregoing, the electrode according to the present invention contains in its coating a considerable amount of tin oxide (30 to 60 mol. %); the prior art processes have not enabled the manufacture of such electrodes without a considerable inefficient overconsumption of a tin compound (tin tetrachloride) which is usually employed for these purposes. The process according to the present invention makes it possible to manufacture the electrode according to the present invention without any inefficient consumption of a tin-containing compound owing to the use of tin dichloride as a tin compound at the above-specified proportions of the starting materials.

It has been also found that tin dichloride in the case of a combined presence in solution with titanium chloride and ruthenium chloride does not volatilize, but comes into tin oxide substantially fully.

The electrode according to the present invention can be subjected to analysis for the determination of the active coating composition in the following manner. The content of ruthenium can be quantitatively determined therein by X-ray-fluorescent method without breaking the active coating. A full analysis of the active coating composition can be performed according to the following procedure: stripping-off the coating, disintegrating thereof, melting with alkalis or oxides of alkali metals and dissolution, followed by quantitative determination of the components by conventional techniques.

EXAMPLE 1

An electrode is produced with a titanium plate substrate having size of 20×30×2 mm and an active coating of the following composition, molar per cent: $SnO_2$ —20.0, $RuO_2$ —15.0, $TiO_2$ —55.0.

The electrode is produced in the following manner.

The titanium plate is degreased in a solution containing 5 g/l of NaOH, 30 g/l of $Na_3PO_4$, 40 g/l of $Na_2CO_3$ at the temperature of 80° C. for 10 minutes, washed in deionized water and etched for 10–15 minutes in a solution of HCl (25%) at the temperature of 100° C.

For application of the active coating a coating solution is prepared from the following starting solutions:

a solution of ruthenium hydroxychloride ($RuOHCl_3$) in water with the concentration of 150 g/l;

a solution of titanium tetrachloride ($TiCl_4$) in water with the concentration of 220 g/l (as calculated for $TiO_2$);

a solution of tin dichloride ($SnCl_2$) in water with the concentration of 301.2 g/l (as calculated for $SnO_2$).

The coating solution contains 4.8 cm$^3$ of the solution of $RuOHCl_3$, 4.3 cm$^3$ of the solution of $TiCl_4$ and 3.2 cm$^3$ of the solution of $SnCl_2$ at the weight ratio of Ru:Ti:Sn=0.325:0.567:0.757 respectively.

The active coating is made multi-layered. Every layer is applied following a similar procedure: the rate of consumption of the coating solution per one layer is 25–30 ml for 1 m$^2$ of the electrode surface. After application of the coating solution the electrode is first dried at the temperature of 150° C., then the first half of the layers is annealed at a temperature within the range of of from 350° to 380° C. for 20 minutes, the subsequent layers are calcined at a temperature of from 470° to 530° C. for 20 minutes, the last layer—for 40 minutes.

The electrode produced according to the present invention was subjected to tests for measurements of its anodic potential and resistance.

The anode potential measurements were effected under the conditions of membrane chlorine electrolysis: concentration of sodium chloride in the anolyte was 280 g/l, current density—1,000; 3,000 and 10,000 A/m$^2$, temperature—80° C.

The electrode resistance was evaluated by the method of variable polarity and amalgamation, as well as by the radio-chemical method.

The method of variable polarity and amalgamation has found an extensive use as a fast method for the assessment of quality of the active coating: resistance to amalgamation, adhesion with the current-conducting substrate, resistance to the cathodic polarization and short-circuits.

The method of variable polarity and amalgamation resides in the following. A test sample at the current density of 1 A/cm$^2$, temperature of 60° C. in a solution with the content of sodium chloride of 300 g/l is subjected alternatively to anodic and cathodic polarization for 40 minutes (2 minutes—anodic polarization, 2 minutes—cathodic polarization). That is, over one cycle of tests lasts for 40 minutes. Then the anode is immersed for 30 seconds into a sodium amalgam with the concentration of sodium of 0.2% by mass. After these operations the anode is rinsed in distilled water, dried and its weight loss is determined.

The radiochemical method of analysis resides in that a sample with the active mass is irradiated with a flux of neutrons ($1.2-3.0\times10^{13}$ neutrons/cm$^2$.s) for a period of 200 to 400 hours, then in electrolysis the radioactive isotope of ruthenium is quantitatively determined in solution, slime, in the gas phase.

The test results are shown in the Table hereinbelow (sample A).

EXAMPLE 2

The electrode is produced in a manner similar to that described in the foregoing Example 1, but with an active coating of the following composition, molar per cent: $SnO_2$ —60.0, $RuO_2$ —15.0, $TiO_2$ —25.0.

For application of the active coating a coating solution is prepared from solutions of ruthenium hydroxychloride ($RuOHCl_3$), titanium tetrachloride ($TiCl_4$) and tin dichloride ($SnCl_2$) described in Example 1 hereinabove.

The coating solution contains 4.8 cm$^3$ of the solution of $RuOHCl_3$, 1.9 cm$^3$ of the solution of $TiCl_4$ and 6.4 cm$^3$ of the solution of $SnCl_2$ at the weight ratio of Ru:Ti:Sn=0.325:0.567:1.520.

The thus-produced electrode (sample B) was tested under the conditions described in Example 1; the rest results are shown in the Table hereinbelow.

EXAMPLE 3

The electrode is produced in a manner similar to that described in Example 1, except that the active coating has the following composition, molar per cent: $SnO_2$ —30,0, $RuO_2$ —30,0, $TiO_2$ —40.0.

For application of the active coating a coating solution is prepared from solutions of ruthenium hydroxychloride ($RuOHCl_3$) , titanium tetrachloride ($TiCl_4$) and tin dichloride ($SnCl_2$) described in Example 1 hereinbefore.

The coating solution contains 9.6 cm$^3$ of the solution of $RuOHCl_3$ , 3.1 cm$^3$ of the solution of $TiCl_4$ and 3.2 cm$^3$ of the solution of $SnCl_2$ at the weight ratio of Ru:Ti:Sn=0.651:0.408:0.757.

The thus-produced electrode (sample C) was tested under the conditions described in Example 1; the test results are given in the Table hereinbelow.

EXAMPLE 4

The electrode is produced in a manner similar to that described in Example 1, except that the active coating has the following composition, molar per cent: $SnO_2$ —30.0, $RuO_2$ —25.0, $TiO_2$ —45.0.

For application of the active coating a coating solution is prepared from the solutions of ruthenium hydroxychloride ($RuOHCl_3$), titanium tetrachloride ($TiCl_4$) and solution of tin dichloride ($SnCl_2$) described in Example 1.

The coating solution contains 8 cm$^3$ of the solution of $RuOHCl_3$, 3.5 cm$^3$ of the solution of $TiCl_4$ and 3.2 cm$^3$ of the solution of $SnCl_2$ at the weight ratio of Ru:Ti:Sn=0.542:0.461:0.757.

The resulting electrode (sample D) was tested under the conditions described in Example 1; the test results are shown in the Table hereinbelow.

Furthermore, the thus-produced electrode was tested under the conditions of chlorate electrolysis: 400 g/l of $NaClO_3$, 100 g/l of NaCl, pH=7, current density is 1,000 to 3,000 A/m$^2$, temperature 80° C. The potential measured under these conditions is equal to 1.36 V (nhe) at the current density of 1,000 A/m$^2$; 1.39 V (nhe) at the current density of 2,000 A/m$^2$ and 1.43 V (nhe) at the current density of 3,000 A/m$^2$.

The same electrode was tested under the conditions of electrolysis of solutions containing 50 g/l of sodium chloride at the current density of 1,000 A/m$^2$ at the temperature of 60° C. to produce sodium hypochlorite. Under these conditions the anode potential was equal to 1.37 V (nhe).

EXAMPLE 5

The electrode is produced in a manner similar to that described in Example 1 hereinbefore, except that the active coating has the following composition, molar per cent: $SnO_2$ —45.0, $RuO_2$ —25.0, $TiO_2$ —30.0.

For application of the active coating a coating solution is prepared from solutions of ruthenium hydroxychloride ($RuOHCl_3$), titanium tetrachloride ($TiCl_4$) and tin dichloride ($SnCl_2$) described in Example 1.

The coating solution contains 8 cm$^3$ of the solution of $RuOHCl_3$, 2.3 cm$^3$ of the solution of $TiCl_4$ and 4.8 cm$^3$ of the solution of $SnCl_2$ at the weight ratio of Ru:Ti:Sn=0.542:0.302:1.139.

The resulting electrode (sample E) was tested under the conditions described in Example 1; the test results are shown in the Table hereinbelow.

EXAMPLE 6

The electrode is produced in a manner similar to that described in Example 1, except that the active coating has the following composition, molar per cent: $SnO_2$ —25.0, $RuO_2$ —20.0, $TiO_2$ —55.0.

For application of the active coating a coating solution is prepared from solutions of ruthenium hydroxychloride ($RuOHCl_3$), titanium tetrachloride ($TiCl_4$) and tin dichloride ($SnCl_2$) described in Example 1 hereinbefore.

The coating solution contains 6.4 cm$^3$ of the solution of $RuOHCl_3$, 4.3 cm$^3$ of the solution of $TiCl_4$ and 2.7 cm$^3$ of the solution of $SnCl_2$ at the weight ratio of Ru:Ti:Sn =0.434:0.567:0.638.

The resulting electrode (sample F) was tested under the conditions described in Example 1; the test results are shown in the Table hereinbelow.

EXAMPLE 7

The electrode is produced in a manner similar to that described in Example 1, except that the active coating has the following composition, molar per cent: $SnO_2$—65.0, $RuO_2$—15.0, $TiO_2$—20.0.

For application of the active coating a coating solution is prepared from solutions of ruthenium hydroxychloride ($RuOHCl_3$) titanium tetrachloride ($TiCl_4$) and tin dichloride ($SnCl_2$) described in Example 1 hereinbefore.

The coating solution contains 4.8 $cm^3$ of the solution of $RuOHCl_3$, 1.55 $cm^3$ of the solution of $TiCl_4$ and 6.9 $cm^3$ of the solution of $SnCl_2$ at the weight ratio of Ru:Ti:Sn=0.325:0.204:1.639.

The resulting electrode (sample G) was tested under the conditions similar to those described in Example 1; the test results are shown in the Table hereinbelow.

EXAMPLE 8

The electrode is produced in a manner similar to that described in Example 1, except that the active coating has the following composition, molar per cent: $SnO_2$—13.2, $RuO_2$—19.8, $TiO_2$—67.0.

For application of the active coating a coating solution is prepared from solutions of ruthenium hydroxychloride ($RuOHCl_3$), titanium tetrachloride ($TiCl_4$) and tin dichloride ($SnCl_2$) described in Example 1 hereinbefore.

The coating solution contains 6.34 $cm^3$ of the solution of $RuOHCl_3$, 5.2 $cm^3$ of the solution of $TiCl_4$ and 1.41 $cm^3$ of the solution of $SnCl_2$ at the weight ratio of Ru:Ti:Sn=0.434:0.687:0.338.

The resulting electrode (sample H) was tested under the conditions described in Example 1 hereinbefore; the test results are shown in the Table hereinbelow.

EXAMPLE 9

An electrode is produced which comprises a current-conducting substrate from a metal passivating upon an anodic polarization, namely titanium shaped as a plate with the size of 20×30×2 mm with a deposited thereonto an active coating having the following composition, molar per cent: $RuO_2$—25, $TiO_2$—45, $SnO_2$—30. The titanium plate is degreased in a solution containing 5 g/l of NaOH, 30 g/l of $Na_3PO_4$, 40 g/l of $Na_2CO_3$ at the temperature of 80° C. for 10 minutes. Then the electrode is rinsed and etched in a solution of HCl (25%) at the temperature of 100° C. for 15 minutes. After rinsing in deionized water and drying an active layer is deposited in the following manner.

A mixture of oxides of $RuO_2$, $TiO_2$ and $SnO_2$ is disintegrated and screened through a sieve with holes of 30 μm. With the account of the surface area of the titanium substrate a weighed portion of oxides is taken at the rate of 1.5 mg/$cm^2$. The powder is uniformly settled onto the substrate placed on the bottom of a vessel by way of sedimentation in an alcohol or acetone. The electrode with the settled powder is dried and then calcined in air at a temperature within the range of from 450° to 600° C. for 10 minutes. The sample is then placed into a vacuum chamber and treated with an electron beam at the scanning frequency of 20 Hz and treatment current of 80μA.

The thus-produced electrode (sample I) was tested under the conditions described in Example 1. The test results are shown in the Table hereinbelow.

As regards its quality, the electrode according to the present invention is not inferior to other electrodes produced by processes involving thermal decomposition of compounds of Sn, Ti and Ru, but these processes are labour-consuming, necessitate the use of a sophisticated process equipment and economically inefficient in the commercial manufacture of large-size electrodes.

EXAMPLE 10

An electrode produced as in Example 1 with the active coating of the following composition, molar per cent: $TiO_2$—45.0, $RuO_2$—25.0, $SnO_2$—30.0 was tested under the conditions of electrolysis of waste waters containing 17 mg/l of phenols at the current density of 2.2 A/$cm^2$, pH=3.8. The effect of purification of the waste waters from the phenols is 96% at the power consumption rate of 24 kWh/$m^3$.

EXAMPLE 11

An electrode produced as in Example 1 with the active coating of the following composition, molar per cent: $TiO_2$—45.0, $RuO_2$—25.0, $SnO_2$—30.0 is used in a process of gold plating of articles. The electrolyte contains $KAu(CN)_2$—30 g/l, citric acid—100 g/l, KOH—40 g/l, cobalt sulphate—100 mg/l.

The process is conducted at the pH=3.5, temperature of 30° C., current density of 10 mA/$cm^2$. The current yield in the process of gold-plating of a copper cathode is 92%.

EXAMPLE 12

A known electrode is produced which comprises a current-conducting substrate of a titanium plate with the size of 20×30×2 mm having an active coating applied thereonto of the following composition, molar per cent: $TiO_2$—67.0, $RuO_2$—33.0.

For application of the active coating a coating solution is prepared from the following starting solutions:

a solution of ruthenium hydroxychloride ($RuOHCl_3$) in water with the concentration of 150 g/l;

a solution of titanium tetrachloride ($TiCl_4$) in water with the concentration of 220 g/l (as calculated for $TiO_2$).

The coating solution contains 10.6 $cm^3$ of the solution of $RuOHCl_3$ and 5.2 $cm^3$ of the solution of $TiCl_4$. The active coating is produced multi-layered. Each layer is applied following the same procedure: the rate of consumption of the coating solution for 1 layer is 25–30 ml/$m^2$. 4–6 layers are applied with the total consumption of ruthenium of 5–6 g/$m^2$ of the electrode surface. After application of the coating solution the electrode is first dried at the temperature of 150° C., then the first half of the layers is annealed at the temperature of 350° C. for 20 minutes, the subsequent layers are calcined at the temperature of 450° C. for 20 minutes, the final layer—for 40 minutes.

The test results for this electrode are shown in the following Table.

The thus-produced electrode (sample ORTA) has the composition of the active coating corresponding to that of the known electrode of USSR Inventor's Certificate No. 369923.

TABLE

| Nos | Characteristics | Sample ORTA | Sample A | Sample B | Sample C | Sample D | Sample E | Sample F | Sample G | Sample H | Sample I |
|---|---|---|---|---|---|---|---|---|---|---|---|
| | Proportions of oxides in the coatting, mol. %: | | | | | 1. 30 | 45 | 25 | 65 | 13.2 | 30 |
| 1 | $SnO_2$ | — | 30 | 60 | 30 | 2. 25 | 25 | 20 | 15 | 19.8 | 25 |
| 2 | $RuO_2$ | 33 | 15 | 15 | 30 | 3. 45 | 30 | 55 | 20 | 67 | 45 |
| 3 | $TiO_2$ | 67 | 55 | 25 | 40 | | | | | | |
| | Anode potential at the current density: | | | | | 4. 1.31 | 1.30 | 1.32 | 1.31 | 1.32 | 1.31 |
| 4 | 1,000 $A/m^2$ | 1.31 | 1.31 | 1.30 | 1.30 | 5. 1.33 | 1.32 | 1.35 | 1.34 | 1.32 | |
| 5 | 3,000 $A/m^2$ | 1.34 | 1.33 | 1.33 | 1.33 | 6. 1.36 | 1.35 | 1.40 | 1.39 | 1.38 | 1.35 |
| 6 | 10,000 $A/m^2$ Volts relative to nhe) | 1.40 | 1.36 | 1.35 | 1.35 | | | | | | |
| 7 | Electrode resistance by the method of variable polarity and almagamation, $mg/cm^2$ | 0.2 | 0.07 | 0.06 | 0.06 | 7. 0.07 | 0.05 | 0.15 | 0.14 | 0.16 | 0.08 |
| 8 | Electrode resistance by the radioactivation method, $g/cm^2 \cdot h$ at $2A/cm^2$ | $3.8 \times 10^{-8}$ | $2.2 \times 10^{-8}$ | $2.1 \times 10^{-8}$ | $2.0 \times 10^{-8}$ | $8.1.9 \times 10^{-8}$ | $1.6 \times 10^{-8}$ | $3.0 \times 10^{-8}$ | $2.7 \times 10^{-8}$ | $2.6 \times 10^{-8}$ | $2.0 \times 10^{-8}$ |

What is claimed is:

1. An electrode for electrolysis of solutions of electrolytes comprising a substrate of a passivating metal; a coating applied onto said substrate and consisting of a mixture of oxides of ruthenium, titanium and tin at the following proportions, molar per cent:

| | |
|---|---|
| ruthenium oxide | 15–30 |
| titanium oxide | 25–55 |
| tin oxide | 30–60 |

2. An electrode for electrolysis of solutions of electrolytes according to claim 1, wherein said coating contains the following ingredients, molar per cent:

| | |
|---|---|
| ruthenium oxide | 25–30 |

-continued

| | |
|---|---|
| titanium oxide | 30–45 |
| tin oxide | 30–40 |

3. A process for producing an electrode for electrolysis of solutions of electrolytes, wherein the following operations are successively performed at least once:

(1) application of a coating solution containing titanium tetrachloride, ruthenium hydroxychloride and tin dichloride in an amount thereof at which the weight ratio of ruthenium to titanium and tin is equal to (0.3–0.7):(0.3–0.6):(0.7–1.5) respectively, onto a substrate of a passivating metal;

(2) drying of the substrate with the coating applied thereonto at a temperature of from 30° to 150° C.;

(3) calcination of the substrate with the coating applied thereon at a temperature within the range of from 350° to 530° C.

* * * * *